US005489476A

United States Patent [19]

Dischler

[11] Patent Number: 5,489,476

[45] Date of Patent: Feb. 6, 1996

[54] TEXTILE FABRIC HAVING FIBERS IMPACTED BY PARTICLES

[75] Inventor: Louis Dischler, Spartanburg, S.C.

[73] Assignee: Milliken Research Corporation, Spartanburg, S.C.

[21] Appl. No.: 310,229

[22] Filed: Sep. 21, 1994

Related U.S. Application Data

[60] Division of Ser. No. 190,694, Feb. 1, 1994, Pat. No. 5,404, 625, which is a continuation-in-part of Ser. No. 596,271, Oct. 12, 1990, Pat. No. 5,363,599.

[51] Int. Cl.[6] ..... D02G 3/00

[52] U.S. Cl. ..... 428/400; 428/192; 428/193; 428/221; 428/224; 428/357; 428/364; 428/365; 428/397; 428/398; 428/399; 428/408

[58] Field of Search ..... 428/408, 192, 428/193, 221, 224, 357, 364, 365, 397, 398, 399, 400

[56] References Cited

U.S. PATENT DOCUMENTS 4,755,335 7/1988 Ghorashi ..... 264/88

*Primary Examiner*—Patrick J. Ryan
*Assistant Examiner*—Richard C. Weisberger
*Attorney, Agent, or Firm*—Terry T. Moyer; Kevin M. Kercher

[57] ABSTRACT

Method and apparatus for modifying fabric and fiber by impaction with particles that create axially aligned micro-cracks and increased porosity allowing penetration of dye-stuffs into the fiber or fabric without the need for swelling agents or carriers.

6 Claims, 5 Drawing Sheets

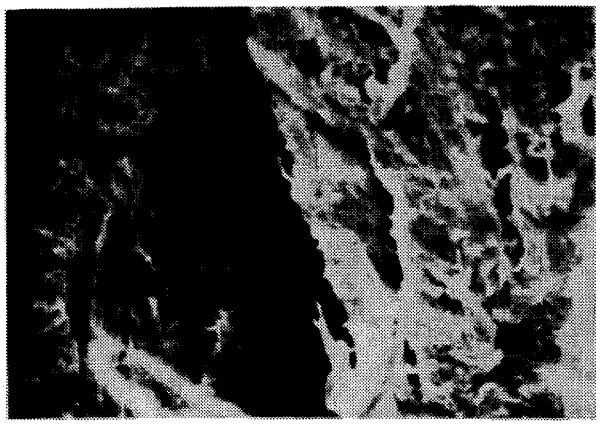
FIG. —4—
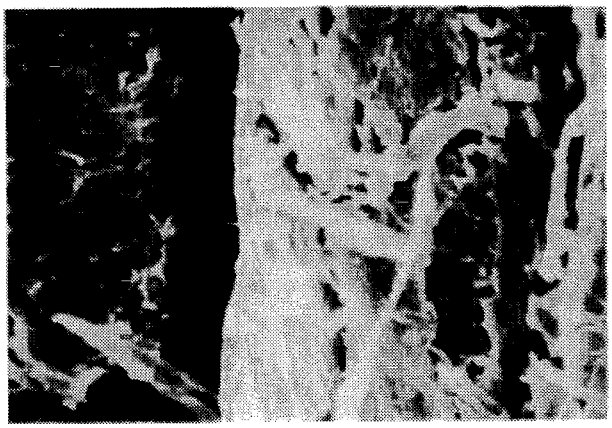
FIG. —5—
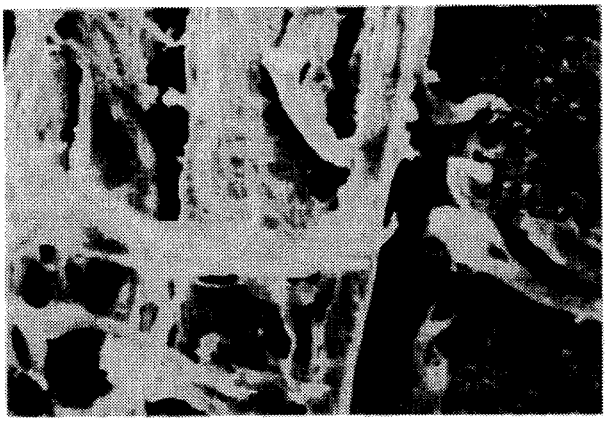
FIG. —6—

TEXTILE FABRIC HAVING FIBERS IMPACTED BY PARTICLES

CROSS REFERENCE TO RELATED APPLICATION

This application is a division of U.S. App. Ser. No. 08/190,694, filed Feb. 1, 1994, now U.S. Pat. No. 5,404,625 a continuation-in-part of U.S. application Serial No. 07/596, 271 filed Oct. 12, 1990, now U.S. Pat. No. 5,363,599.

BACKGROUND OF THE INVENTION

This invention relates to particle impact treatment of fibers and fabric in order to enhance the dyeability characteristics of fabrics or fibers that are difficult and sometimes impossible to dye such as aromatic polyamides (polyaramids).

Polyaramids have been found to be well-suited for applications in areas exposed to transient or continuous high temperatures and for personal protection such as in ballistic vests and in cut resistant gloves. In areas where high temperature resistance and dyeability are important, fabrics constructed of relatively low modulus aramid fibers such as those of poly(meta-phenylene isophthalamide) are used. In areas where high strength is of primary importance, as in ballistic protection, fabrics of high modulus aramid fibers such as poly(para-phenylene terephthalamide) are used. Fabrics constructed of such high modulus aromatic polyamide fibers, hereinafter known as HM-aramid fibers, are extremely difficult to dye, while lower modulus aramid fibers, hereafter known as LM-aramid fibers can be dyed to dark shades only by use of suitable swelling agents or carriers. Therefore, it would be highly desirable to modify the HM-aramid fibers to produce a dyeable fabric with minimal degradation to physical properties. Likewise, it would be desirable to modify LM-aramid fibers to produce a fabric dyeable without recourse to environmentally problematic chemical agents.

The present invention solves the above problems in a manner not disclosed in the known prior art.

SUMMARY OF THE INVENTION

Method and apparatus for modifying fiber or fabric by impaction with particles that create axially aligned microcracks and increased porosity allowing penetration of dyestuffs into the fiber or fabric without the need for swelling agents or carriers.

It is an advantage of this invention to provide a highly textured fiber surface.

It is another advantage of this invention to provide axially directed cracks and enlargement of pore size for acceptance of dyestuff.

Yet another advantage of this invention is that highly structured fabrics such as para-aramids are equally susceptible to treatment as less structured meta-aramids.

Still another advantage of this invention is that after treatment, aramid fiber is readily dyeable in basic or disperse dyes for medium and dark shades and sulfur dyes for light shades.

Another advantage of this invention is that the hand of the fabric or fiber is relatively unchanged.

Yet another advantage of this invention is that the fiber may be treated in either fiber or fabric form.

In another advantage of this invention, when treated in fabric form, the reduction in strength is minimal with very few broken filaments with the treatment affecting primarily the top layer of fibers.

These and other advantages will be in part obvious and in part pointed out below.

BRIEF DESCRIPTION OF THE DRAWINGS

The above as well as other objects of the invention will become more apparent from the following detailed description of the preferred embodiments of the invention, which when taken together with the accompanying drawings, in which:

FIG. 4 is a photomicrograph of KEVLAR® (para-polyaramid) at 2500× magnification after being treated by bicarbonate of soda;

FIG. 5 is a photomicrograph of KEVLAR® (para-polyaramid) at 2500× magnification after being treated by bicarbonate of soda;

FIG. 6 is a photomicrograph of KEVLAR® (para-polyaramid) at 2500× magnification after being treated by bicarbonate of soda;

Corresponding reference characters indicate corresponding parts throughout the several views of the drawings.

DETAILED DESCRIPTION OF THE PREFERRED EMBODIMENT

Figure 1:
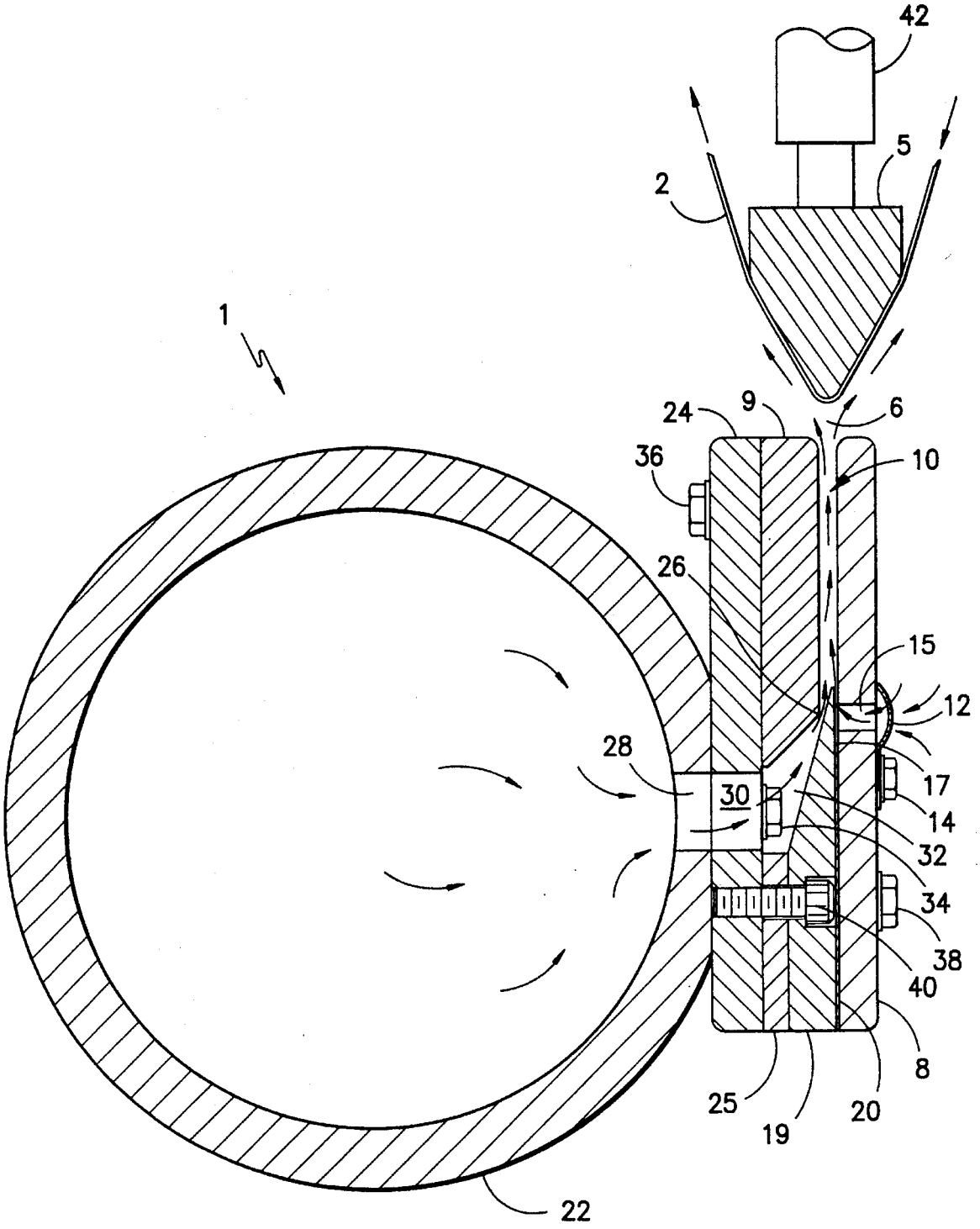
FIG. 1 is a cross-sectional view of a particle impact assembly constructed in accordance with the present invention.

Referring now by reference numerals to the drawings, and first to FIG. 1, a particle impact apparatus is generally indicated by numeral 1. Fabric 2 is supplied, with its full open width, to the apparatus 1 by a standard fabric delivery means that is not shown. The fabric 2 is directed through an acute angle by means of contact with a back-up bar 5. There is a treatment area 6 in which particles are accelerated to just below sonic velocity by means of a acceleration chamber 10 and then impacted against the fabric 2. Acceleration chamber 10 is formed by a top plate 8 and a bottom nozzle plate 9 that extends across the width of the fabric 2, which for most fabrics is about two meters. The apparatus 1 is surrounded by a housing (not shown) to contain the particle laden air.

The ambient particle laden air is recycled through the apparatus 1 by being drawn into the acceleration chamber 10 by means of filter 12 and orifice 15. The filter 12 is attached to the top plate 8 by means of bolt 14. The amount of air brought into the acceleration chamber 10 is regulated by the gap 17 between the top plate 8 and the top nozzle plate 19. This gap 17 is set by a first spacer plate 20. Compressed air used to accelerate the particles is-delivered by manifold 22 to converging/diverging nozzle 26 via a plurality of communicating passages 28 and 30 to sub-manifold 32, which is formed by top nozzle plate 19, bottom nozzle plate 9, base plate 24, and a second spacer plate 25. The thickness of the second spacer plate 25 determines the gap of the converging/diverging nozzle 26.

The manifold 22 is connected to the base plate 24 by means of a series of bolts 34 or any other equivalent means of interconnection such as conventional hardware, adhesives, welding, brazing, and so forth as is typical throughout this application. A series of bolts 36 attach the base plate 24 to the bottom nozzle plate 9. A series of bolts 38 connect the top plate 8 to the first spacer plate 20 and top nozzle plate 19. There is another series of bolts 40 connecting the top nozzle plate 19 to the second spacer plate 25 and to base plate 24.

The gap between the back-up bar 5 and the exit of the acceleration chamber 10 is controlled by actuator 42. Raising the back-up bar 5 reduces and then eliminates the treatment. Lowering the bar 5 to nearly block off the exit of acceleration chamber 10 produces enough back pressure to reverse the flow through orifice 15 and filter 12, thereby cleaning the filter 12.

Figure 2:
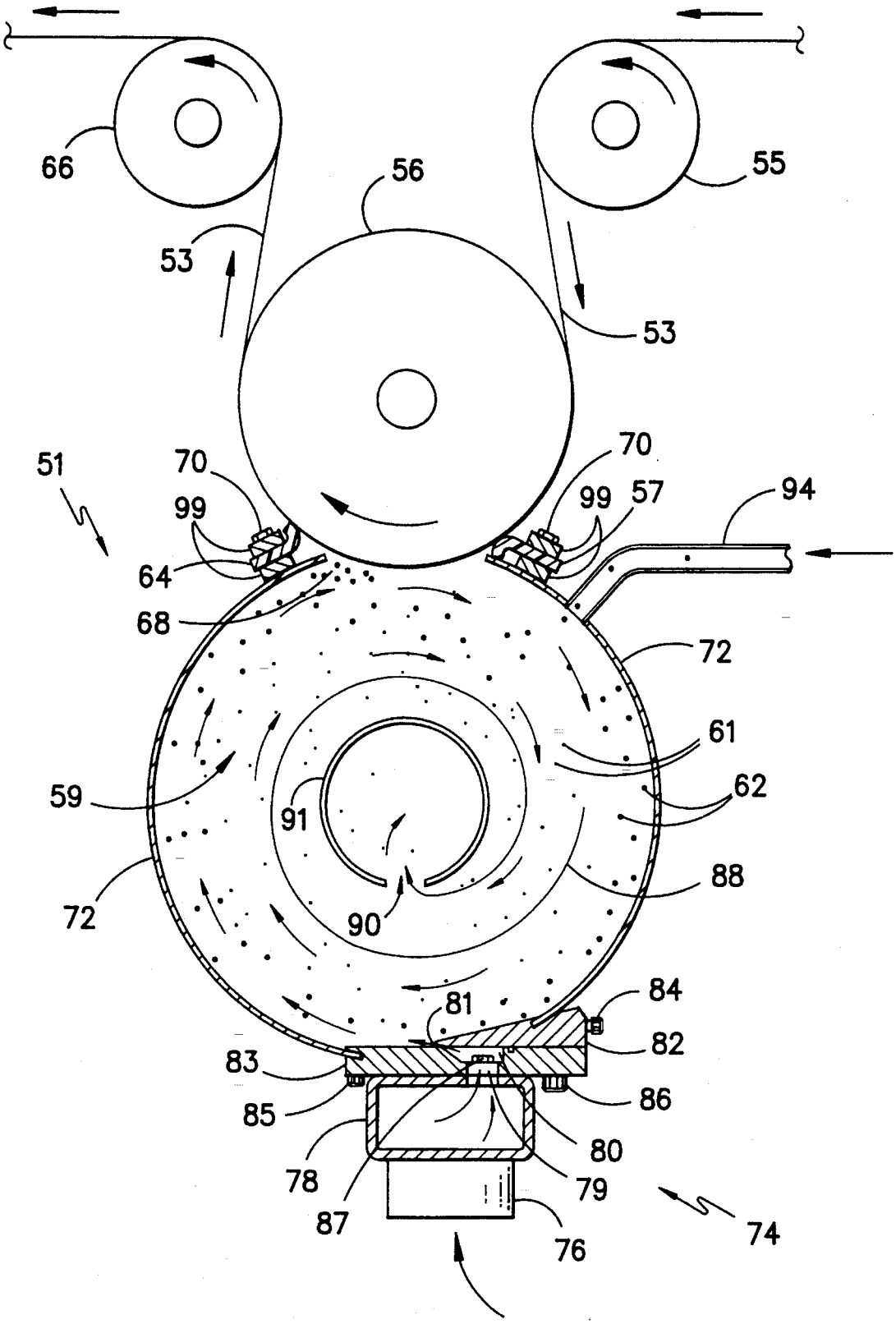
FIG. 2 is a cross-sectional view of an alternative embodiment of a particle impact assembly.
Figure 3:
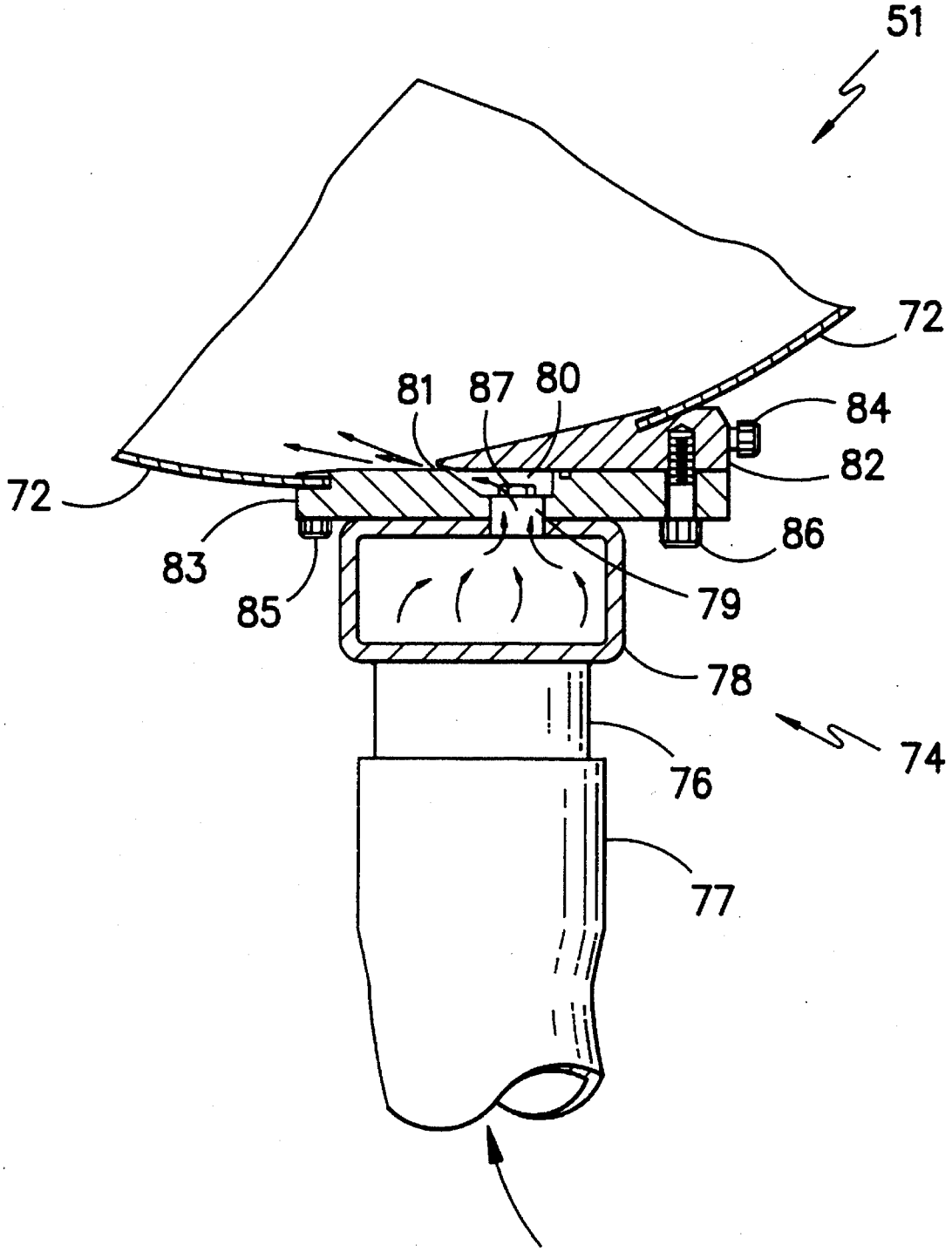
FIG. 3 is a cross-sectional view of one of the gas jets shown in FIG. 2 employed in practicing the present invention.

An alternative particle impact apparatus is generally indicated by numeral 51, as shown in FIGS. 2 and 3. Fabric 53 is supplied open width over idler roll 55 and then under treatment back-up roll 56, past input seal 57 and then into the air driven vortex that is generally indicated by numeral 59. Treatment is effected by impact with near sonic velocity large particles 62 and small particles 61 in the impact area 68. The fabric 53 then exits the vortex 59 past exit seal 64 and over idler roll 66. The input seal 57 is "J"-shaped and facing downward toward the cylindrical wall 72 of the apparatus 51. The exit seal 64 is also "J"-shaped and relatively similar to the input seal 57 but facing upward away from the cylindrical walls of the apparatus 51. Both input seal 57 and exit seal 64 are held in position by a combination of dual blocks 99 on each side of each seal 57 and 64 and interconnecting bolts 70 that connect the seals 57, 64 to the cylindrical wall 72. A conventional fabric delivery, take-up and tensioning means are used and not shown.

Referring now to FIG. 3, a gas jet is generally indicated by numeral 74 with gas being supplied from a gas hose 77, which is preferable constructed out of rubber or any other material that can carry gas at high pressure, and is connected to tube inlet 76 into the manifold 78 that supplies pressurized gas to through passage 79 that communicates with sub-manifold 80 that ejects the gas by means of a converging/diverging nozzle 81. This converging/diverging nozzle 81 is formed by top plate 82 and base plate 83. Both of these plates 82 and 83 are attached to the curved plates that form the cylindrical wall 72 by means of locking screws 84 and 85 respectively. The top plate 82 is fastened to the base plate 83 by means of screw 86. The manifold 78 is fastened to the base plate 83 by means of screw 87. Any equivalent structure that creates a gas nozzle tangential to the interior of the curved surface may be used.

Referring again to FIG. 2, the near sonic air stream ejected from the converging/diverging nozzle 81 is forced into the spiralling path 88, where most of its original energy is lost before escaping the air driven vortex 59 via exhaust passage 90 that extends along the longitudinal axis of the cylindrical exhaust manifold 91. It can be appreciated that the centrifugal effects of the air driven vortex 59 is to preferentially drive the large sonic velocity particles 62 against the cylindrical wall 72. The air exhausted by the exhaust manifold 91 is relatively enriched in small treatment particles 61. The exhausted particles 61 are replenished by a cylindrical supply tube 94.

Both apparatus 1 and 51 have the advantage of treating fabric continuously across the width and of recycling the treatment particles. Apparatus 51 has the additional advantage of efficiently utilizing all of the energy in the air stream and is immune to clogging.

The type of particle or particles to be used in both embodiments should be small, high speed particles, that could be in the form of a powder, which have a hardness comparable to or less than that of the fiber. This is so the fiber may undergo repeated impacts with breaking or cutting. A preferred substance is bicarbonate of soda due to its low cost, fine particle characteristics, nontoxicity, low hardness (2.5 on Mohs scale) and ease of removal due to its soluble nature.

Figure 7:
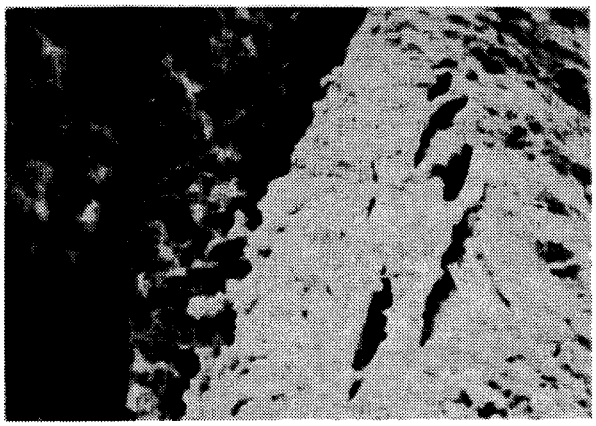
FIG. 7 is a photomicrograph of NOMEX® (meta-polyaramid) at 2500× magnification after being treated by bicarbonate of soda.
Figure 8:
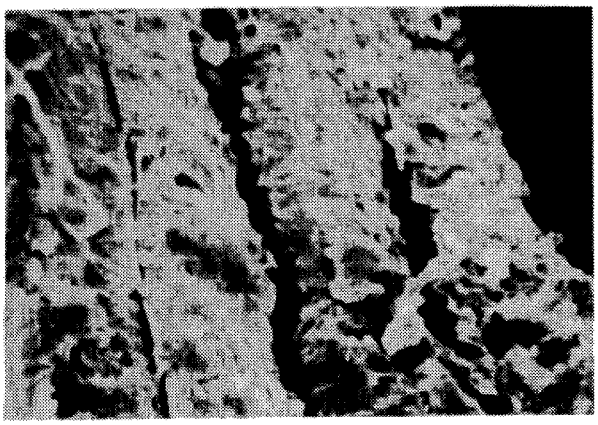
FIG. 8 is a photomicrograph of NOMEX® (meta-polyaramid) at 2500× magnification after being treated by bicarbonate of soda.
Figure 9:
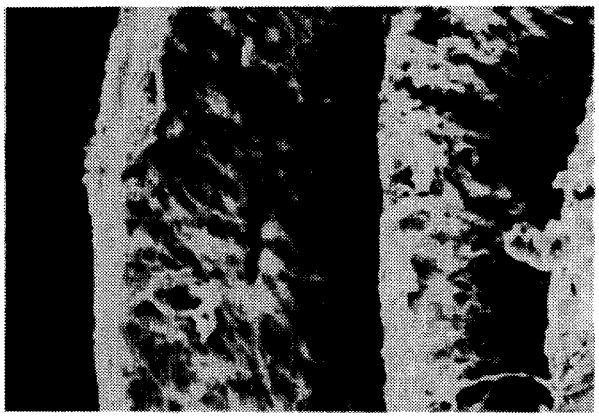
FIG. 9 is a photomicrograph of NOMEX® (meta-polyaramid) at 2500× magnification after being treated by bicarbonate of soda.

Upon treatment, a highly textured fiber surface is formed with axially aligned cracks. This treatment is equally effective for a highly structured para-aramid such as KEVLAR® fabric and the less structured meta-aramid NOMEX® both manufactured by E. I. duPont Nemours and Co. and described in U.S. Pat. No. 4,198,494. FIGS. 4, 5 and 6 are photomicrographs at 2500× magnification of KEVLAR® fibers after impact treatment and FIGS. 7, 8 and 9 are photomicrographs at 2500× magnification of NOMEX® fibers after impact treatment.

The treated Kevlar® fabric is readily dyeable without carriers by either basic or disperse dyes in medium to dark shades, as well as by sulfur dyes in light shades. Dyeing begins at one hundred degrees Celsius, but pressure dyeing is preferred at one hundred and thirty degrees Celsius for speed and uniformity. It is believed that the microcracks between the microfibrils that make up the fiber as well as the mechanical enlargement of pore size, are both induced by the impact treatment and responsible for the dyeability of the fibers.

When the treatment is performed in fabric form, the reduction in strength is minimal due to the fact that only the top layer of fibers is treated, with very few broken filaments. The hand of the fabric is virtually unchanged by impact treatment. Impact treatment may be effectuated in either fabric or fiber form.

The dyeability of the fabric is significantly reduced by the presence of water during treatment. It is believed that the plasticization of the less crystalline regions between the micro-fibers retards the formation of micro-cracks.

It is not intended that the scope of the invention be limited to the specific embodiment illustrated and described. Rather, it is intended that the scope of the invention be defined by the appended claims and their equivalents.

What is claimed is:

1. A textile fabric that is readily dyeable in basic, disperse and sulfur dyes comprising of aromatic polyamide fibers wherein said aromatic polyamide fibers include axially aligned cracks therein mechanically induced by impact with particles having a hardness comparable to or less than said aromatic polyamide fibers, wherein said impact does not result in any significant reduction in strength of said textile fabric.

2. A textile fabric as defined in claim 1, wherein said aromatic polyamide fibers are substantially high modulus aramid fibers.

3. A textile fabric as defined in claim 2, wherein said textile fabric is dyeable without carriers.

4. A textile fabric as defined in claim 2, wherein said aromatic polyamide fibers are substantially poly (para-phenylene terephthalamide).

5. A textile fabric as defined in claim 2, wherein said aromatic polyamide fibers are substantially low modulus aramid fibers.

6. A textile fabric as defined in claim 5, wherein said aromatic polyamide fibers are substantially poly (meta-phenylene terephthalamide).

* * * * *